US010760235B1

(12) United States Patent
Edmondson Klingback

(10) Patent No.: US 10,760,235 B1
(45) Date of Patent: Sep. 1, 2020

(54) FRAC STAND SAFETY WORK PLATFORM

(71) Applicant: Todd Edmondson Klingback, Killdeer, ND (US)

(72) Inventor: Todd Edmondson Klingback, Killdeer, ND (US)

( * ) Notice: Subject to any disclaimer, the term of this patent is extended or adjusted under 35 U.S.C. 154(b) by 0 days.

(21) Appl. No.: 16/515,212

(22) Filed: Jul. 18, 2019

(51) Int. Cl.

| | |
|---|---|
| ***E21B 41/00*** | (2006.01) |
| ***E04G 3/24*** | (2006.01) |
| ***E02B 17/06*** | (2006.01) |
| ***E21B 15/00*** | (2006.01) |
| *E02B 17/00* | (2006.01) |
| *E21B 43/26* | (2006.01) |

(52) U.S. Cl.
CPC ..... *E02B 17/06* (2013.01); *E21B 15/003* (2013.01); *E02B 2017/0056* (2013.01); *E21B 43/26* (2013.01)

(58) Field of Classification Search
CPC ..... E02B 17/06; E02B 2017/0056; E21B 15/003; E21B 43/26; E04G 1/06; E04G 3/24
See application file for complete search history.

(56) References Cited

U.S. PATENT DOCUMENTS 4,068,737 A * 1/1978 Lenz ..... B66F 11/04 182/146
4,163,625 A * 8/1979 Jenkins ..... E21B 19/14 175/85
5,671,823 A * 9/1997 Oakes ..... E04G 3/00 182/36
6,681,894 B1 * 1/2004 Fanguy ..... E04G 1/36 182/113
8,302,736 B1 * 11/2012 Olivier ..... E21B 15/00 182/187
8,746,403 B1 * 6/2014 Tyner ..... E06C 1/30 182/106
8,757,954 B1 * 6/2014 Roy ..... B63B 27/16 114/368
9,027,712 B2 * 5/2015 Melton ..... E04G 1/34 182/223
9,080,336 B1 * 7/2015 Yantis ..... E04G 3/24
9,689,233 B2 * 6/2017 Nguyen ..... E21B 33/06
(Continued)

*Primary Examiner* — Benjamin F Fiorello
(74) *Attorney, Agent, or Firm* — Jonathan Sip

(57) ABSTRACT

An elevated workspace platform for rapid installation over and around wellhead equipment, frac trees and manifolds for providing oilfield worker access to equipment. Lift points provide engagement with forklift or other lifting machinery for deployment onsite and do not require any personnel to be underneath. Foldable support legs are securely locked into upright configuration with a hand operated spring-loaded latch. Reinforced steel plate boxes surround and achor the support legs to the elevated platform. Modularized design allows the platform to be stackable for transport to the oilfield work site. Removable and adjustable height stairways, handrails and self-closing gates ensure worker safety and access to equipment. Leveling jacks compensate for uneven ground surface conditions. Safety features reduced slips and falls and decrease insurance costs. Rigid structure provides workspace for installation, operation and servicing wellhead equipment, valves, fittings, pipelines, lubrication, and high-pressure hydraulic fracturing fluid lines and hoses.

20 Claims, 7 Drawing Sheets

(56) References Cited

U.S. PATENT DOCUMENTS

| | | | | |
|---|---|---|---|---|
| 9,963,888 | B2 * | 5/2018 | Ledet | E04G 3/24 |
| 9,970,241 | B2 * | 5/2018 | Ledet | E21B 15/00 |
| 10,494,890 | B2 * | 12/2019 | van der Zwet | E04G 1/36 |
| 2004/0011592 | A1 * | 1/2004 | Lee | E21B 41/00 182/187 |
| 2012/0006618 | A1 * | 1/2012 | DuBose | B60P 1/00 182/112 |
| 2012/0006619 | A1 * | 1/2012 | DuBose | B60P 1/00 182/113 |
| 2012/0312825 | A1 * | 12/2012 | Kennedy | B60R 3/02 220/660 |
| 2018/0283110 | A1 * | 10/2018 | van der Zwet | E21B 33/061 |
| 2019/0093429 | A1 * | 3/2019 | Russell | E06C 1/393 |

* cited by examiner

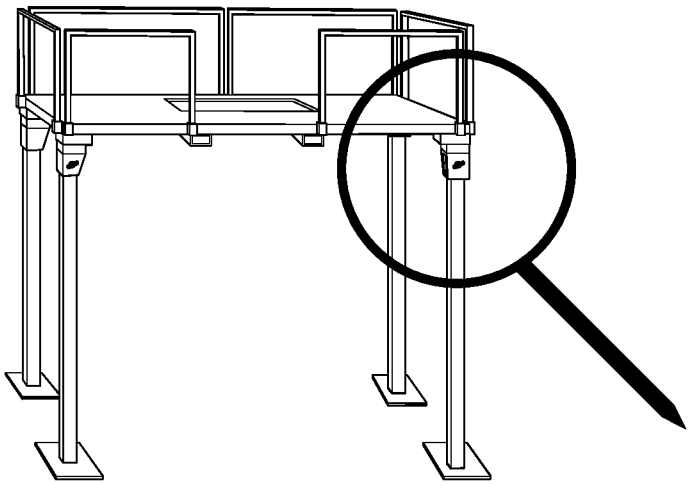
Fig. 04
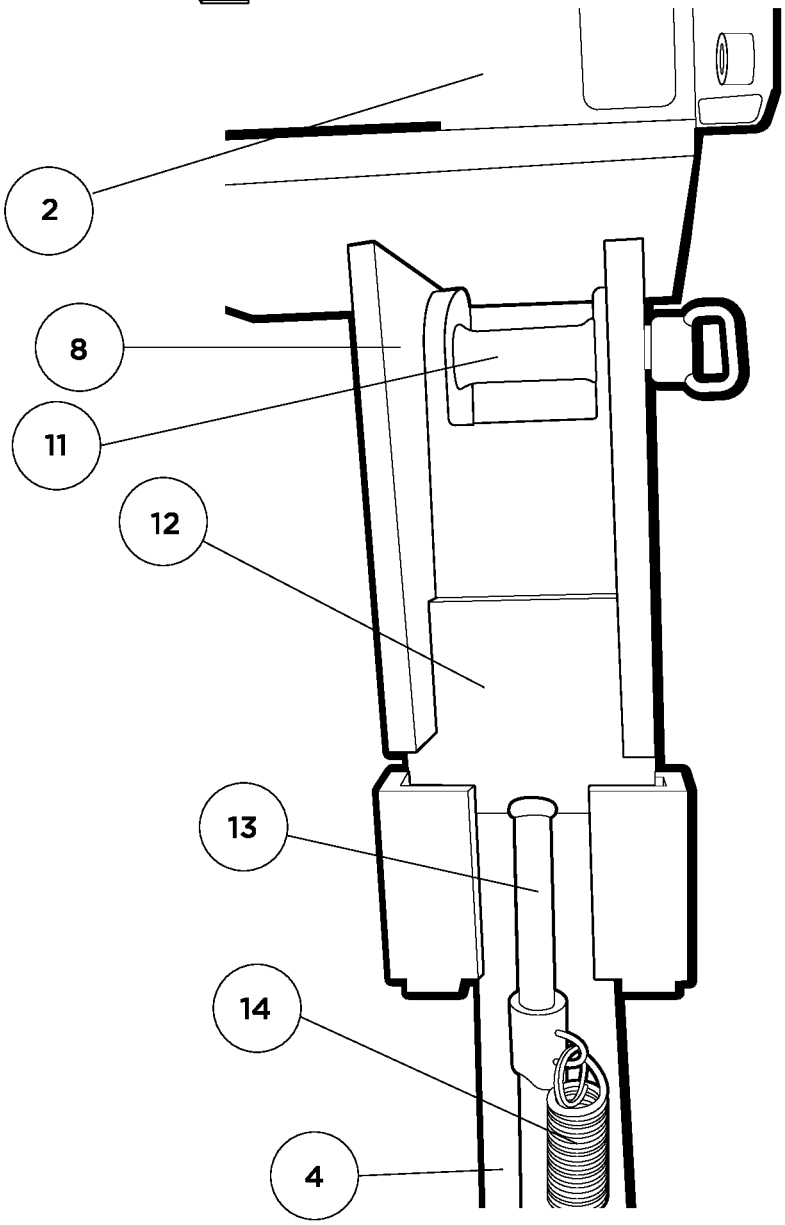

FRAC STAND SAFETY WORK PLATFORM

BACKGROUND

In recent years, horizontal directional drilling techniques combined with hydraulic fracturing has enabled the previously thought impossible harvest of natural gas resources from impermeable rock and shale formations. Hydraulic fracturing is a process whereby a fluid, typically water, brine, emulsions of oil and water, or liquid-gas foams, are injected into the ground at high pressure to stimulate, create cracks and fracture the rock or shale formation to increase the flow and recovery of oil and gas. Sand or other proppant material is typically injected to prop open the cracks in the formation, increase permeability, and allow the oil or gas to flow to the well. Vertical and horizontal rotary drilling methods are typically treated with multiple fracturing jobs to create numerous artificial fractures in the formation and recover more oil and gas.

At the wellhead, the equipment for hydraulic fracturing generally includes multiple fluid tanks, chemical blenders, pipes and flowlines, valves, manifolds and pressure control devices, high-pressure high-volume pumping units, and proppant and chemical storage, many of which are brought in and mounted on specialized trucks. The water, proppant and chemicals are mixed to form fracturing fluid and then injected into the wellbore at operating pressures upwards of 15,000 PSI. The flow of fracturing fluid, oil and gas in and out of pipes in the well is controlled and regulated at the surface with a manifold, christmas tree, or frac tree structure, which is an assembly of valves, spools, and fittings. The frac tree may also provides additional features for chemical injection points, pressure relief, and pressure gauges, transducers, flowmeters, and other sensors for monitoring and measuring fracturing parameters. Fluids and gases are pumped in and out of the manifold or frac tree via multiple flexible high-pressure lines and hoses that are typically powered with configurations of ten 1,650 HHP triplex pumping units.

During the hydraulic fracturing treatment of a wellhead, the frac tree and manifold must be safely accessed by oilfield services personnel for the installation, control, operation, maintenance and removal of specialized equipment. Mounted on top of the wellhead, the frac trees and manifold structures are typically overhead and out of reach of oilfield workers and are built to heights of around fifteen feet or more. In the past, oilfield workers gained access to the frac tree with moveable vertical man lifts, boom lifts or scissor lift equipment. However, these methods of access proved unsafe due to operator error, falls, collapse, tip overs, and the inherently dangerous conditions at the oilfield. Therefore a safer means of accessing the frac tree and manifold is needed.

SUMMARY

The presently described invention provides for a frac tree manifold and wellhead access safety work platform. The frac stand safety work platform allows and provides elevated access to the wellhead hydraulic fracturing equipment by oilfield services personnel. Oilfield workers may safely and reliably access the wellhead, frac tree and manifold with the presently described frac stand safety platform. The frac stand make possible the safe installation of frac tree and manifold equipment, manipulation of hand wheels, valve service, pressure control, maintenance and repair work, support of heavy tools and equipment, as well as high-pressure line installation and removal. Worker safety is vastly improved and accidents are reduced as compared with previous man and boom lift approaches. The frac stands provide a safe work area that is rapidly deployed and installed onsite to provide the worker with multiple levels of stable access to areas surrounding the frac tree, manifold, and wellhead equipment.

The presently described frac stands provide folding legs for stackable transportation to the wellhead site, and provide quick deployment and installation over the frac tree and manifold wellhead equipment. The frac stand is lifted over the worksite, the legs are unfolded, and locked into place. Installation and deployment is faster and safer than previous work platforms, and does not require workers to be underneath. Safety railing around the frac stand work platform area, and the use of stairways in place of ladders, provides increased oilfield worker safety and complies with OSHA safety regulations and standards, and reduces insurance costs. The frac stand also preferably provides self-closing gates, handrails, adjustable railings, a larger work platform for worker mobility and space, adjustable leveling stairways and leg jacks, and safety color schemes for worksite safety. The frac stands provide multiple levels of access and a safe work platform area allow the oilfield worker to safely access the frac tree and wellhead equipment and install, service and remove hydraulic fracturing equipment in an otherwise dangerous workplace.

DESCRIPTION OF THE DRAWINGS

FIG. 04 is a detailed view of the frac stand locking legs mechanism.

DETAILED DESCRIPTION

Figure 1:
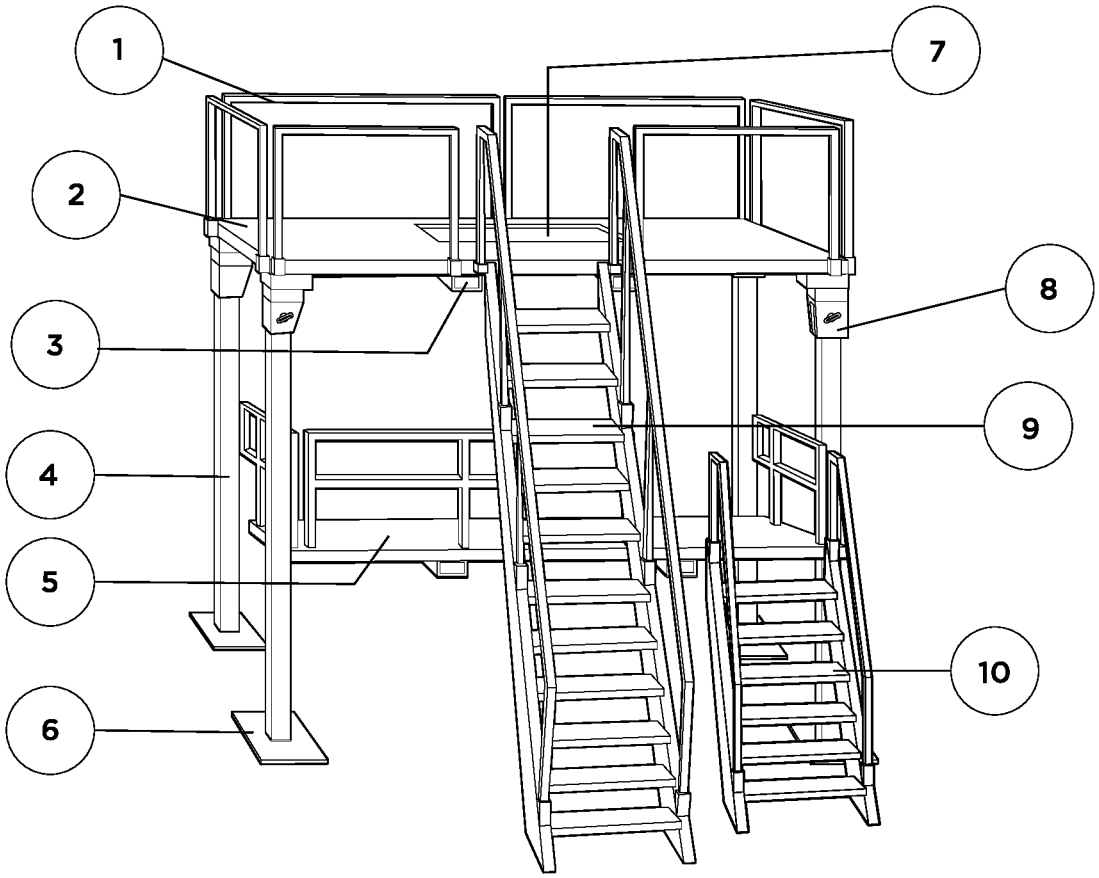
FIG. 01 is a view of the frac stand safety work platform, providing multiple levels of access to the wellhead and equipment, handrails, stairways and a large, stable and level workspace platform area.

The frac stands safety work platform is used in the oilfield preferably for oil and gas drilling operations and for wellhead equipment installation and services related to drilling completion, stimulation and performing hydraulic fracturing treatments. The frac stands meet safety standards and provide oilfield workers access to the wellhead equipment, such as frac trees and manifolds, and a workspace for the installation and removal of high-pressure lines and hoses, manipulation of control valves, and for servicing, maintenance and operation of other wellhead equipment and devices.

In a preferred embodiment the frac stand safety work platform provides oilfield workers with elevated access to the wellhead for installation, operation and maintenance of frac trees and manifolds. Workers are provided a safe work space and access with the frac stand for pressure control valve manipulation; turning hand-wheels; servicing valves, chokes, seals, and fittings; torquing wellhead, pipeline and casing fittings; greasing and lubrication jobs; and the servicing of high-pressure lines and hoses for hydraulic fracturing fluid delivery. The frac stand safety platform vastly improves worker safety in comparison with previous man and boom lift approaches for access. The frac stand provides an elevated work area for heavy tools and equipment, with multiple levels, stairways, handrails and self-closing gates for OSHA safety compliance and access to all areas around the wellhead equipment and frac tree.

In a preferred embodiment the frac stand safety platform folding legs provide rapid installment with spring loaded latches, and locking legs. The folding legs allow the frac stand work platform to be folded, and stackable, for transportation to and from the oilfield and wellhead site. The frac stand safety platform may be lifted and maneuvered into place over the wellhead area equipment with a forklift, crane, or boom. Workers do not have to stand underneath the frac stand platform to install and lock the legs into place. As the frac stand is lifted over wellhead equipment, the legs swing into place and are locked and latched with a spring loaded mechanism. The foldable legs may be removable for transport, and are adjustable for platform height.

In a preferred embodiment, the frac stand safety platform folding and locking legs provide a locking mechanism comprising a spring-loaded rod which slides a lock-plate into a slotted box at the leg pivot point underneath the platform. As the frac stand is lifted into place, and the legs swing from folded to upright position, the legs are locked with the spring loaded latch mechanism. In a preferred embodiment, the oilfield worker manipulates the latch to rotate the rod and spring-loaded mechanism to slide the lock-plate into the slotted box near the leg pivot point. The spring-loaded locking mechanism secures the platform legs into upright configuration for use.

In a preferred embodiment, the folding and locking legs mechanism provides a three-quarter inch (¾-in.) reinforced steel plate box surrounding the pivot point around which the legs pivot for folding during transport and installation. The lock-plate is slid into a slotted groove in the steel plate box near the pivot point to lock the legs into place at the wellhead site. The lock-plate is slid into the box via the spring-loaded rod and latch. Preferably, the folding and pivoting legs may be surrounded with one and one-half feet (1½ ft.) of three-quarter inch (¾-in.) reinforced steel plate for strength, durability, and fail-safe design at the oilfield work site.

The frac stand safety work platform is designed for OSHA safety compliance and to provide a safe work space for oilfield workers and reduce insurance costs. The platform provides more room, surface area and multiple levels of access to the wellhead equipment for the worker. The increased work space, over previous designs, allows the oilfield worker to have complete three-hundred and sixty degrees of access to the wellhead, frac tree, valves, lines and hoses for fracking operations. Worker ergonomics and safety are improved with the added platform work space to eliminate the need to crawl over or underneath valves or other equipment to gain access. Slips and falls are reduced with the elimination of dangerous ladder access means. The frac stand safety work platform preferably provides level stairways, adjustable handrails and locking gates to protect the worker and allow safety compliant access to wellhead equipment. The frac stand and stairways may be leveled with jacks at the ground level surface contact points, which may be comprised of an uneven surface level.

In a preferred embodiment, the frac stand safety work platform is comprised of a modular design in which the individual components are foldable or removable for transport and installation at the oilfield worksite. The frac stand may be folded for transport, with a pivoting and locking leg mechanism for rapid deployment and installation over wellhead equipment. Additionally, the legs, stairways, and adjustable handrails may be separately removable from the platform work area for transport and configurability at the wellhead. The elevated platform area may also be adjustable to fit around and provide access to different sized wellheads, frac trees and manifolds. The frac stand work platform may provide multiple levels of access to the wellhead equipment, frac tree and manifold via multiple stairways with handrails and self-closing gates. The frac stand work area elevated platforms may preferably surround and provide worker access to all areas of the wellhead equipment via an adjustable cutout space or passthrough in the center for the wellhead, pipelines, fittings, valves, frac tree or manifold.

In a preferred embodiment or use-case scenario, the oilfield worker deploys and installs the frac stand safety work platform at the wellhead site to provide access to the wellhead equipment, frac tree, manifold, or other oil and gas field equipment. The frac stand provides an elevated work platform for access to all areas around the wellhead equipment. The frac stand is preferably transported by truck or tractor trailer in a folded and modular configuration to the oilfield. The platform, pivoting legs, handrails, and stairways are assembled onsite. The frac stand may preferably arrive at the oilfield with the legs in folded configuration. Alternatively, the platform legs may be transported separately and detached from the platform and secured onsite at the platform leg pivot points, located at the corners of the platform. The main frac stand platform work area is then off-loaded from the truck, placed on the ground, and the adjustable height handrails may be installed by insertion and mechanical fastening into the receivers located at the corners and edge of the platform. The handrails are preferably comprised of a telescoping adjustable height design, and are installed and locked into place on top of the platform. A forklift is then preferably used to lift the platform into place; the forklift forks securely engage with the platform, preferably by insertion of the forks into rectangular steel tubing sections mounted underneath the platform, and the platform is raised off the ground. The platform legs, if not already installed, may be attached to the corner pivot points at this time; and preferably installation of the legs is accomplished with the platform raised slightly off the ground surface level for access by the worker. With the legs and handrail installed, the platform may be further elevated to full height and the legs swing into the upright position and are locked into place. In a preferred embodiment, the platform provides access to wellhead equipment at a fifteen foot (15-ft.) high elevation from the ground surface level. Other platform heights and elevations are possible by adjusting and configuring the platform legs for optimal height for wellhead access.

Installation is rapidly accomplished by lifting the platform with the forklift, swinging the legs into place, and locking the legs with the rotating latch, rod and spring loaded plate which slides into the box groove or slot near the leg pivot point; and securing the legs in the upright position. The frac stand platform may be raised into place over the wellhead with a forklift, boom, or crane. The stairway with handrails may be installed to provide access to the top of the elevated platform. A self closing gate is preferably installed at the top of the stairway for safety and prevention of slips and falls. The platform legs may preferably be mounted on jacks to level the platform with uneven ground level surface conditions at the oilfield site. The stairway may also be adjustable for leveling with the platform. Additional stairways and multiple platform work areas may also be installed to provide multiple levels of access around the wellhead equipment.

In a preferred embodiment or use case scenario, the oilfield worker installs and deploys the frac stand safety work platform at the worksite for access to the wellhead equipment. The frac stand may be installed over and around the wellhead, frac tree or manifold for access. During oil and gas well drilling, completion and hydraulic fracturing treatments, the frac stand safety work platform provides the oilfield worker an elevated access and work area to the wellhead equipment. In the dangerous oilfield environment, the stairways, handrails, self-closing gate, and elevated platform work area provide the oilfield worker with a safe work space for installation, operation, maintenance and removal of wellhead equipment. The worker may utilize the frac stand safety platform for installing, operating and servicing the wellhead, casings, pressure control valves, choke valves, torquing fittings and connections, and manipulating heavy tools and equipment. The oilfield worker may install, service, and remove hydraulic fracturing fluid delivery hoses and high-pressure lines to the frac tree and wellhead, with access and a safe workspace area as provided with the frac stand safety work platform.

FIG. 01 is a view of the frac stand safety work platform as installed in the upright position, providing multiple levels of access to the wellhead equipment via stairways, and adjustable handrails. The adjustable handrails 1 prevent slips and falls and provide a safe OSHA compliant work space environment for the oil field worker. The frac stand safety platform provides an elevated platform 2 for access to all areas surrounding the wellhead equipment. For installation over wellhead equipment, a forklift may engage with the platform by insertion of the forks into rectangular steel tubing sections 3 mounted underneath the platform. The elevated platform is supported in the upright position with legs 4, which swing from folded to upright position during installation. The platform provides a secondary elevated platform 5 for additional access to areas surrounding the wellhead equipment. The platform legs are supported on ground surface contact plates 6, which may be adjusted with leveling jacks for uneven ground level surfaces. The elevated platform provides an adjustable center cutout space, or pass through 7 to surround the wellhead equipment, frac trees, or manifold. The platform legs are secured at the pivot points 8 with reinforced three-quarter inch (¾-in.) plate steel box sections for strength and durability. The oilfield worker is provided access to the elevated platforms and workspace via stairways 9 and 10.

Figure 2A:
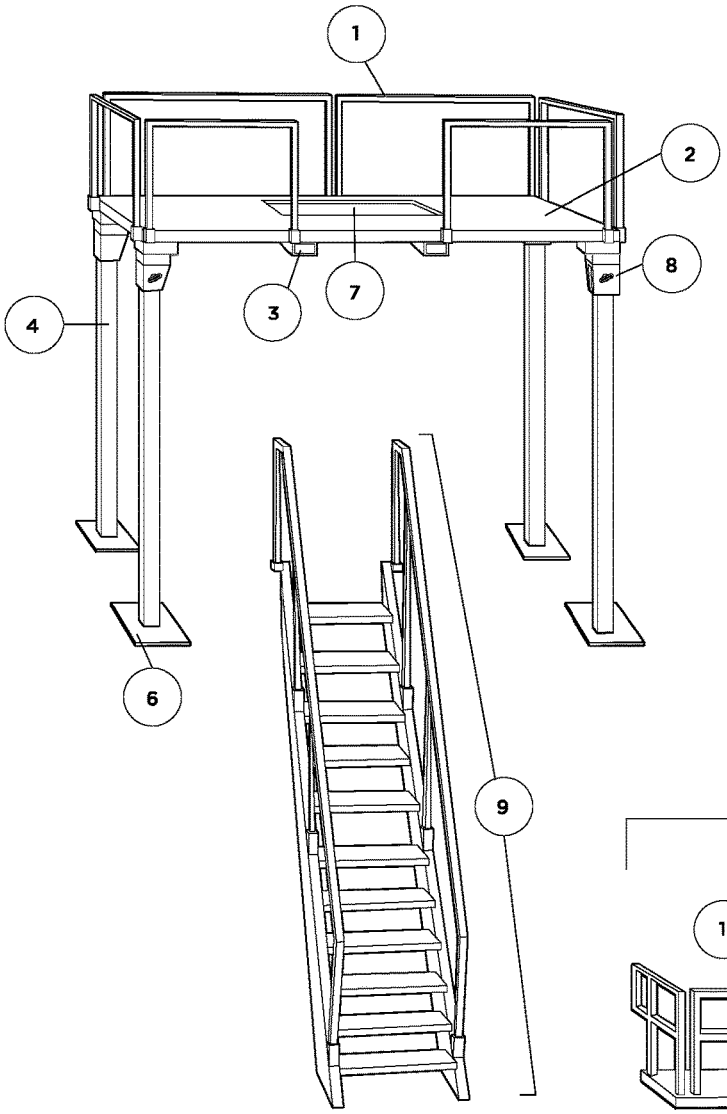
FIG. 02*a* is a view of the frac stand safety work platform components; the worker access stairways, handrails and platform workspace area with cutout for frac tree, manifold or wellhead equipment in the center; the frac stand work platform is supported and leveled with folding and locking legs.
Figure 2B:
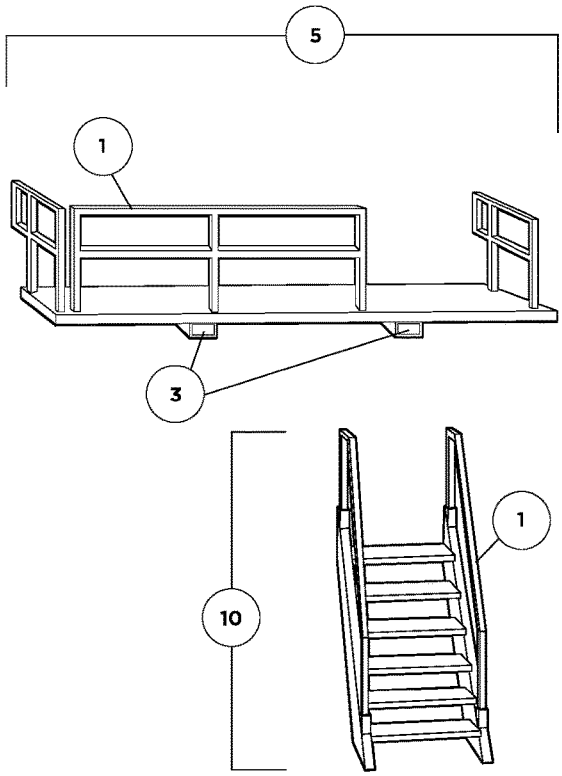
FIG. 02*b* is a view of the frac stand safety work platform components; the worker access stairway, handrails and platform workspace area with cutout for frac tree, manifold or wellhead equipment in the center.

FIG. 02*a* is a view of the frac stand safety work platform with modular construction configurations. The elevated platform work areas (FIG. 02*a*, 2); handrails (FIG. 02*a*, 1); foldable legs (FIG. 02*a*, 4); and stairways (FIG. 02*a*, 9); may be separately transported to the oil field for assembly and installation over the wellhead equipment. The adjustable height handrails (FIG. 02*a*, 1) may be installed onto the platform and the platform lifted with a forklift at the receivers (FIG. 02*a*, 3) for installation of the legs (FIG. 02*a*, 4) at reinforced steel plate box section pivot points (FIG. 02*a*, 8). The legs are locked into place with the platform elevated to full height and placed over the wellhead equipment at the center cutout or pass through (FIG. 02*a*, 7). The platform legs are supported on plates (FIG. 02*a*, 6) which may be leveled with jacks for uneven ground surfaces. The stairways protect workers from slips and falls with handrails (FIG. 02*a*, 1). An additional secondary elevated platform work area (FIG. 02*b*, 5) may be installed underneath the existing work area to provide more access to the wellhead equipment. The secondary platform may be lifted and installed with forklift receivers (FIG. 02*b*, 3). Worker safety is ensured with adjustable height handrails (FIG. 02*b*, 1) and access is provided with a secondary stairway (FIG. 02*b*, 10) with handrails (FIG. 02*b*, 1).

Figure 3A:
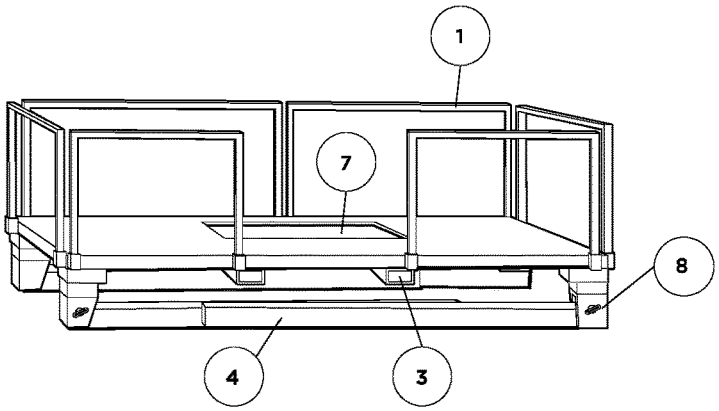
FIG. 03*a* is a view of the frac stand safety work platform with folding and locking legs for transport and rapid installation and deployment at the wellhead site.
Figure 3B:
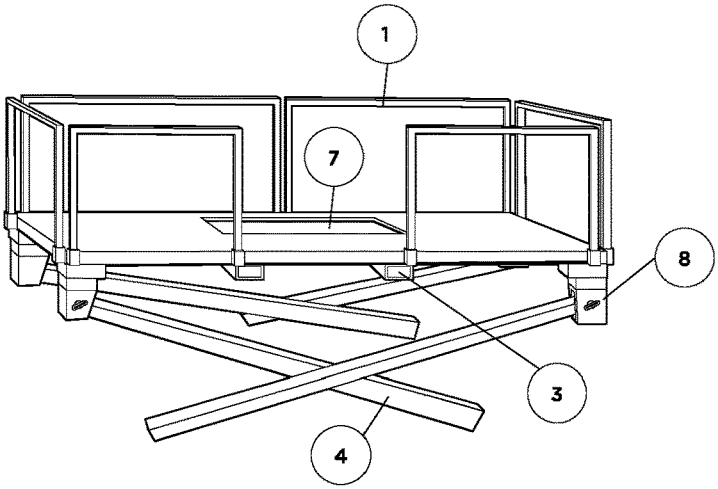
FIG. 03*b* is a view of the frac stand safety work platform with folding and locking legs for transport and rapid installation and deployment at the wellhead site.
Figure 3C:
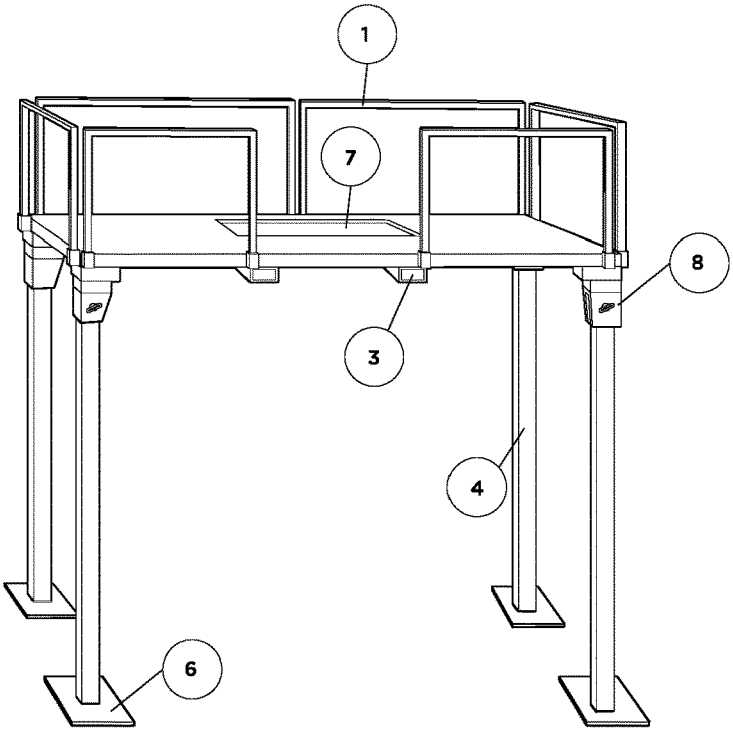
FIG. 03*c* is a view of the frac stand safety work platform with folding and locking legs for transport and rapid installation and deployment at the wellhead site.
Figure 6:
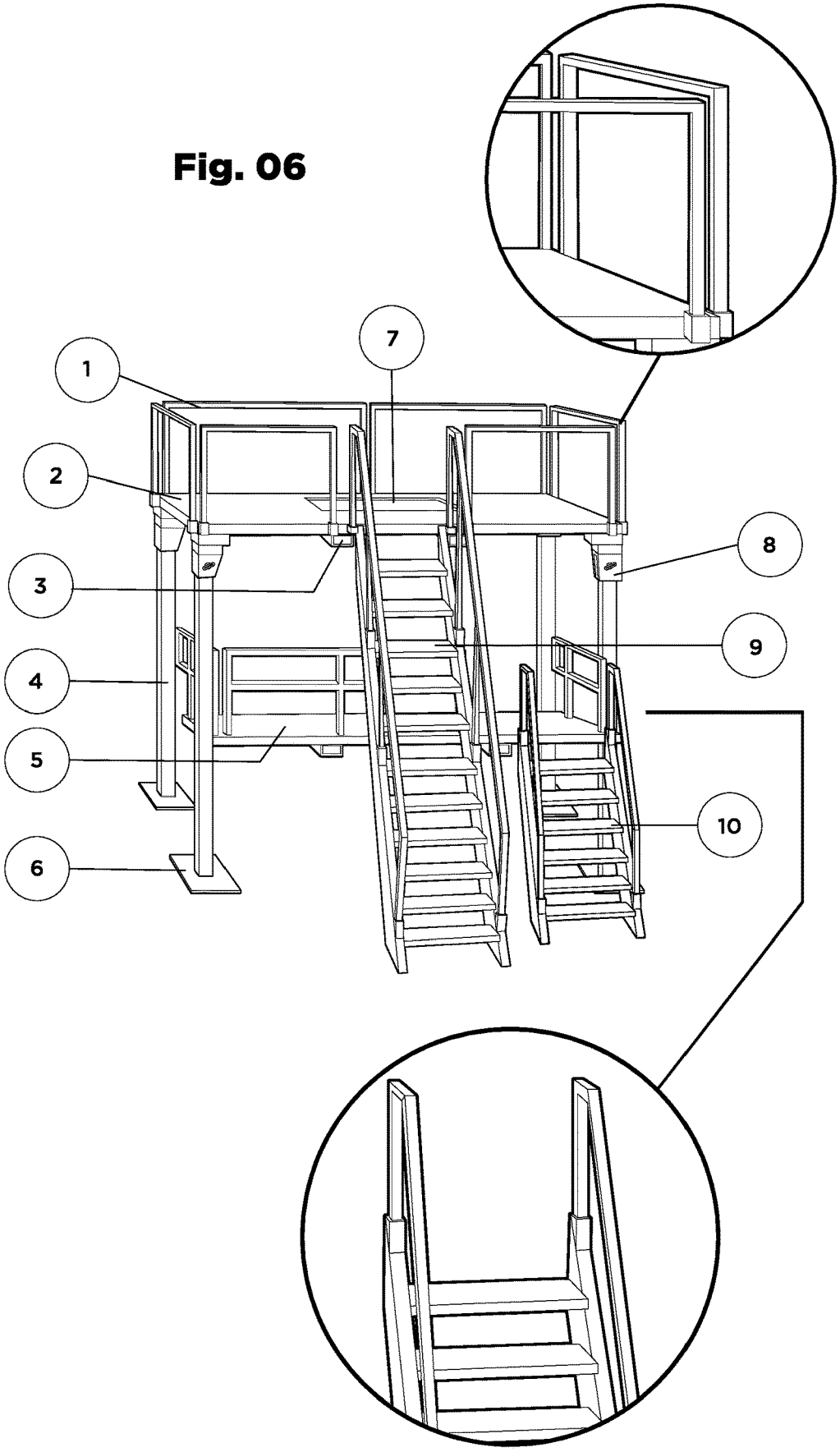
FIG. 06 is a view of the frac stand safety work platform providing multiple levels of access to the wellhead equipment for the oilfield worker, with leveling stairways providing access to the workspace platform, and adjustable safety handrails.

FIG. 03 is a view of the frac stand safety platform with foldable legs for transport and rapid installation at the oil field. The platform is shown in compact folded configuration (FIG. 03*a*) with legs folded (FIG. 03*a*, 4); and legs folded and pivoting around the reinforced steel plate box (FIG. 03*a*, 8) for transport to the work site. The forklift engages with the platform at the receivers (FIG. 03*a*, 3) for lifting and unfolding of the legs (FIG. 03*a*, 4). As the platform is lifted into place, the legs unfold (FIG. 03*b*, 4) and pivot at the reinforced steel plate box (FIG. 03*b*, 8). In the fully extended and upright position, the elevated work platform is moved into place over the wellhead equipment and the legs are locked into upright configuration (FIG. 03*c*, 4). The adjustable center cutout passthrough (FIG. 03*c*, 7) provide space for the wellhead equipment, control valves, frac tree or manifold. The platform is leveled with jacks at the leg support plates (FIG. 03*c*, 6). Handrails protect the workers from slips and falls (FIG. 03*c*, 1).

FIG. 04 is a detailed view of the frac stand safety work platform locking legs mechanism. The foldable legs 4 pivot around the pin 11 and are secured to the platform 2 with reinforced steel plate box sections 8. The legs 4 are locked into place for upright configuration with sliding plate 12 and groove slots. The plate 12 is slid into place with a spring-loaded 14 latch which rotates rod 13 and engages the plate 12 into the groove slot at the steel plate box section 8, which locks the legs into upright configuration to support the elevated platform.

Figure 5:
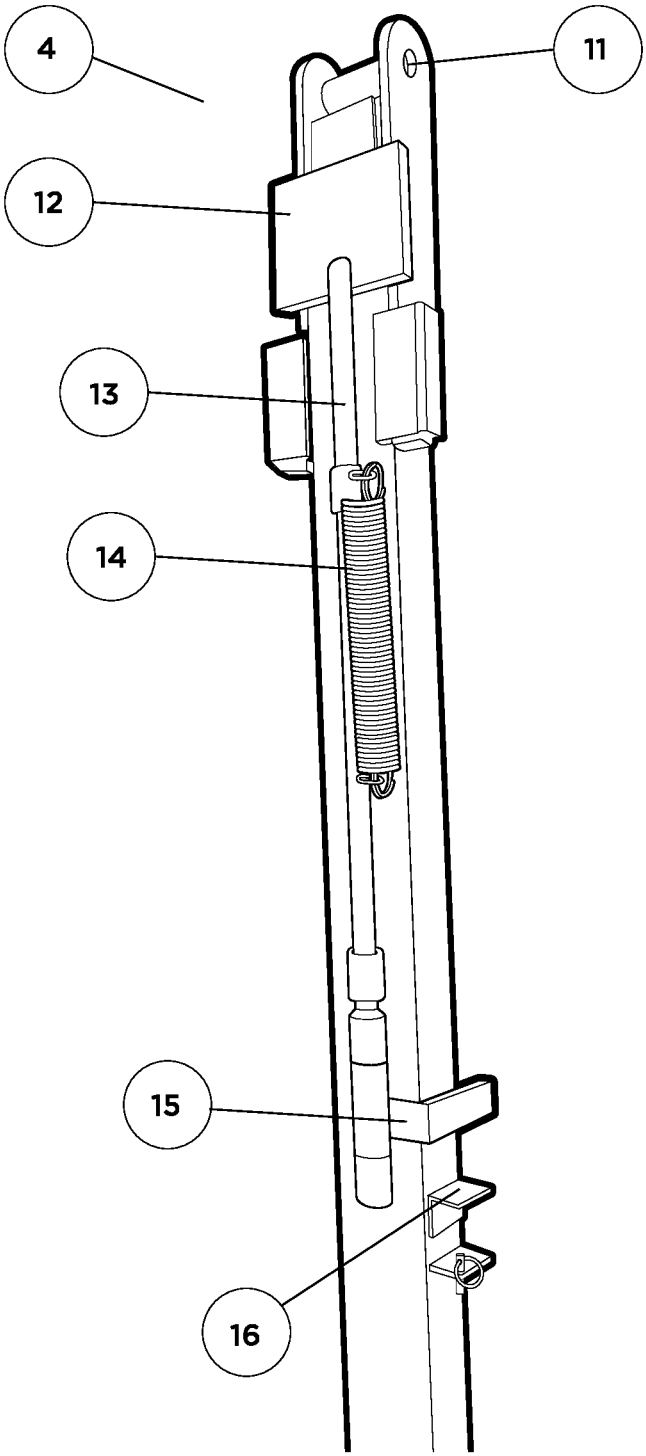
FIG. 05 is a detailed view of the frac stand locking legs mechanism.

FIG. 05 is a detailed view of the platform foldable leg and locking mechanism. The leg 4 may fold and pivot around a pin 11. The hand operated latch 15, with latch receiver 16, is rotated around the leg to engage the spring-loaded locking mechanism. The latch 15 rotates the spring-loaded rod 13 and 14 to engage the plate 12 into the reinforced steel plate box section slot and groove and lock the legs in the upright configuration.

FIG. 06 is a detailed view of the frac stand safety work platform as installed at the work site. The elevated platform 2 provides a work area for access to the wellhead equipment which passes through the adjustable center cutout 7. The adjustable height handrails 1 protect from slips and falls. The platform may preferably be lifted into place with a forklift at engagement point 3. The legs are locked into upright position 4 and secured at the reinforced steel plate box section pivot point 8. The platform is leveled with jacks at the leg support plates 6. The stairway 9 provides the workers with access to the top level elevated platform 2. A secondary elevated platform 5 provides additional work space and access to the wellhead equipment via the stairway with handrails 10.

Figure 7A:
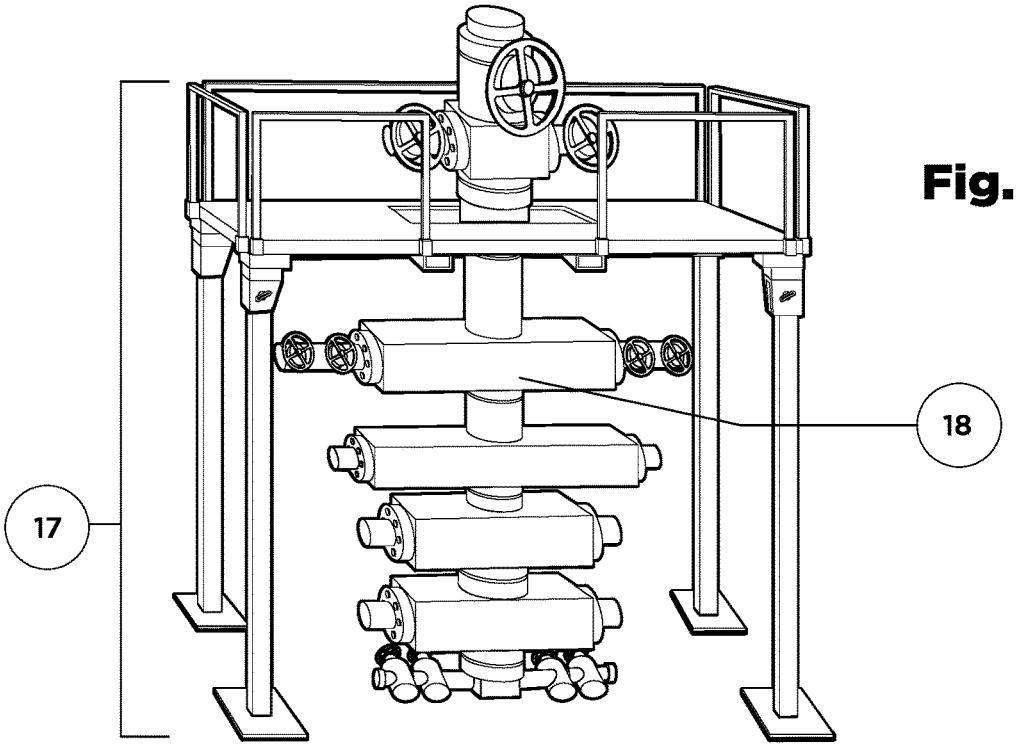
FIG. 07*a* is a view of the frac stand safety work platform providing access to the frac tree, manifold, valves, handwheels, pressure control devices, and for installation and removal of high-pressure lines and hoses, and servicing the wellhead with heavy tools and equipment.
Figure 7B:
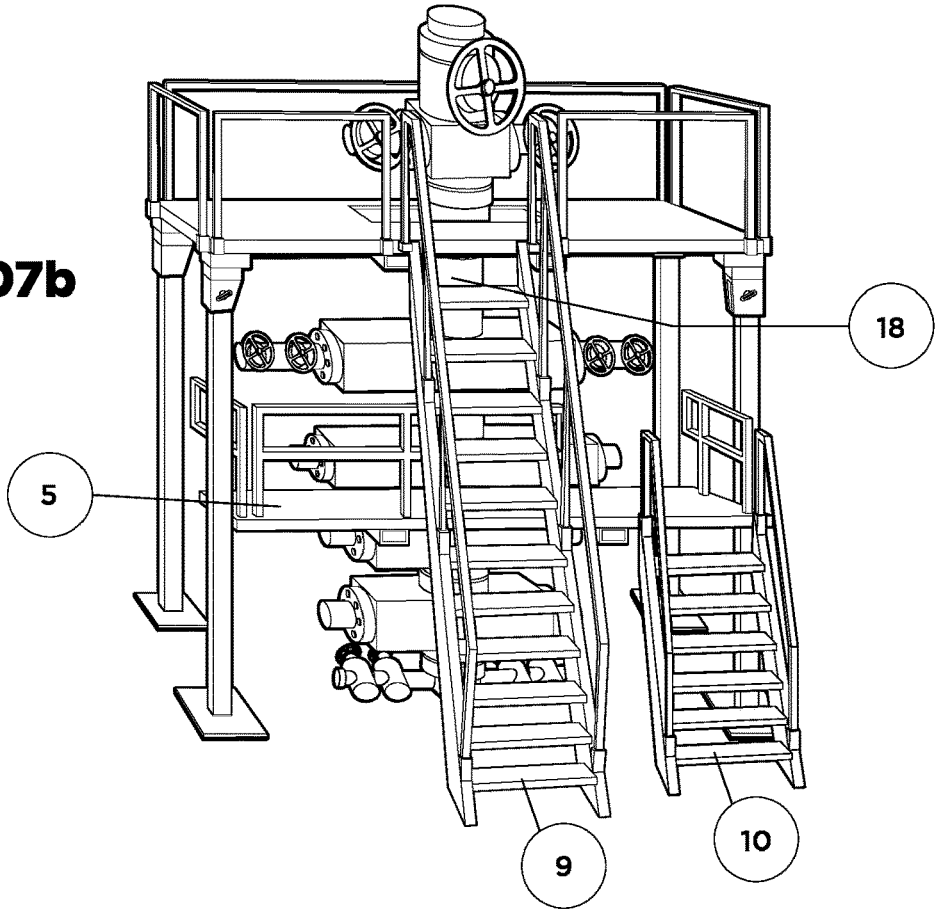
FIG. 07*b* is a view of the frac stand safety work platform providing multiple levels of access to the frac tree, manifold, valves, hand-wheels, pressure control devices, and for installation and removal of high-pressure lines and hoses, and servicing the wellhead with heavy tools and equipment.

FIG. 07*a* is a view of the frac stand safety work platform as installed and deployed at the work site and providing access to the wellhead, frac tree or manifold. The frac stand 17 is installed over the wellhead equipment 18. In FIG. 07*b*, the stairways with handrails 9 and 10 provide the oilfield worker with access to the top level elevated platform and work area as well as access to the secondary platform 5 for additional access to the wellhead equipment 18 and for installation and operation of the frac tree, manifold, valves, and for servicing hydraulic fracturing lines and hoses.

In a preferred embodiment, the frac stand safety platform may be fabricated with carbon steel; round, square or rectangular structural and mechanical steel tubing; steel plate; flat bar; expanded metal grating; and other steel parts, and hardware, including pins and fasteners. The frac stand is preferably fabricated with welding jigs and by welding together structural and mechanical steel sections with wire-feed MIG (metal inert gas), or other shielded metal arc welding techniques. The reinforced steel plate box section may preferably be fabricated with three-quarter inch (¾-in.) steel plate as cut by CNC plasma table.

The invention claimed is:

1. A frac stand safety work platform, comprising:

an elevated workspace with three-hundred and sixty degree walk-around access to wellhead equipment;

foldable legs;

a reinforced steel plate box surrounding and anchoring the legs to the platform at pivot points which are locked into upright configuration with a latch operated rotating rod and spring-loaded sliding plate and groove locking mechanism;

a stairway for access to the elevated workspace; and adjustable height handrails along the elevated workspace perimeter and stairway;

wherein, the frac stand safety work platform may be installed and deployed over and around wellhead equipment; wherein, the platform may be comprised of multiple elevated workspaces and stairways for providing access to wellhead equipment, frac trees or manifolds; and wherein, the legs and stairways are adjustable and leveling for uneven ground surface conditions.

2. The frac stand safety work platform of claim 1, wherein the platform comprises rectangular steel tubing sections for engaging with a forklift and lifting and securing the platform over wellhead equipment by unfolding and locking the legs into upright configuration.

3. The frac stand safety work platform of claim 1, wherein the legs, stairway and handrails are removable so that the platform may provide stackable transportation.

4. The frac stand safety work platform of claim 1, wherein the legs may be height adjusted with jacks to level the platform.

5. The frac stand safety work platform of claim 1, wherein the stairways comprise self-closing gates to prevent slips and falls.

6. The frac stand safety work platform of claim 1, wherein the platform is securely installed over wellhead equipment without requiring an oilfield worker to operate underneath the platform.

7. The frac stand safety work platform of claim 1, wherein the reinforced steel plate box surrounding and anchoring the legs to the platform is comprised of three-quarter inch thick steel plates.

8. A method for installing a frac stand safety work platform, the method comprising the steps of:

engaging a forklift into rectangular steel tubing sections mounted under the platform;

lifting the platform and unfolding pivoting legs mounted to reinforced steel plate boxes at the platform corners;

installing the platform over and around wellhead equipment and thereby providing an elevated workspace with three-hundred and sixty degrees of walk-around access;

locking the platform legs with a latch operated rotating rod and spring-loaded sliding plate and groove mechanism; and attaching a stairway and handrails to the platform;

wherein, the platform may be further comprised of multiple elevated workspace and stairways; and wherein the legs and stairways are adjustable for uneven ground surface conditions.

9. The method of claim 8 for installing a frac stand safety work platform, the method further comprising removable legs, stairway and handrails so that the platform may provide stackable transportation.

10. The method of claim 8 for installing a frac stand safety work platform, the method further comprising adjustable height legs to level the platform.

11. The method of claim 8 for installing a frac stand safety work platform, the method further comprising self-closing gates on stairways to prevent slips and falls.

12. The method of claim 8 for installing a frac stand safety work platform, the method further comprising installation over wellhead equipment without requiring any oilfield workers to operate underneath the platform.

13. The method of claim 8 for installing a frac stand safety work platform, the method further comprising reinforced steel plate boxes surrounding and anchoring the legs to the platform with three-quarter inch thick steel plates.

14. The method of claim 8 for installing a frac stand safety work platform, the method further comprising a platform workspace that improves oilfield worker safety and ergonomics by eliminating the need to crawl over or underneath wellhead equipment.

15. A frac stand safety work platform comprising:

an elevated workspace for providing walk-around access to wellhead equipment;

unfolding platform support legs that are locked into upright configuration with a hand-operated spring-loaded latch;

platform lifting points for raising and installing the platform over and around wellhead equipment; and removable stairways and handrails for providing access the elevated platform;

wherein, the platform support legs are anchored to the platform with reinforced steel plate boxes; wherein, the platform may be comprised of multiple elevated workspaces and stairways; and wherein the support legs and stairways are height adjustable.

16. The frac stand safety work platform of claim 15, wherein the stairways comprise self-closing gates to prevent slips and falls.

17. The frac stand safety work platform of claim 15, wherein installation over wellhead equipment does not require any oilfield workers to operate underneath the platform.

18. The frac stand safety work platform of claim 15, wherein reinforced steel plate boxes are comprised of three-quarter inch thick steel plates.

19. The frac stand safety work platform of claim 15, wherein the platform workspace improves oilfield worker safety and ergonomics by eliminating the need to crawl over or underneath wellhead equipment.

20. The frac stand safety work platform of claim 15, wherein the platform provides a workspace for the installation and operation of high-pressure hydraulic fracturing fluid lines.

* * * * *